US006145441A

United States Patent [19]

Woodall et al.

[11] Patent Number: 6,145,441

[45] **Date of Patent: *Nov. 14, 2000**

[54] FRANGIBLE PAYLOAD-DISPENSING PROJECTILE

[75] Inventors: Robert Woodall, Lynn Haven; Felipe Garcia, Panama City, both of Fla.

[73] Assignee: The United States of America as represented by the Secretary of the Navy, Washington, D.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/056,118

[22] Filed: Apr. 2, 1998

[51] Int. Cl.[7] ..... F42B 8/14

[52] U.S. Cl. ..... 102/502; 102/370; 102/444; 102/513

[58] Field of Search ..... 102/444, 502, 102/513, 370; 473/377–384

[56] References Cited

U.S. PATENT DOCUMENTS

| | | | |
|---|---|---|---|
| 3,515,070 | 6/1970 | Cutler et al. | 102/513 |
| 3,791,303 | 2/1974 | Sweeney et al. | 102/502 |
| 3,865,038 | 2/1975 | Barr | 102/502 |
| 4,686,905 | 8/1987 | Szabo | 102/444 |
| 4,899,660 | 2/1990 | Brighton | 102/513 |
| 5,018,450 | 5/1991 | Smith | 102/502 |
| 5,157,225 | 10/1992 | Adams et al. | 102/493 |
| 5,254,379 | 10/1993 | Kotsiopoulos et al. | 102/502 |
| 5,353,712 | 10/1994 | Olson | 102/513 |
| 5,450,795 | 9/1995 | Adelman | 102/502 |
| 5,547,197 | 8/1996 | Pocklington | 473/384 |
| 5,640,945 | 6/1997 | Slonaker et al. | 124/56 |
| 5,879,245 | 3/1999 | Hwang | 473/384 |
| 5,936,190 | 8/1999 | Buzick | 102/502 |

*Primary Examiner*—Harold J. Tudor

*Attorney, Agent, or Firm*—Harvey A. Gilbert; Donald G. Peck

[57] ABSTRACT

A frangible payload-dispensing projectile has a spherical capsule filled with a dispersible fill material. The exterior surface of the capsule has a plurality of spaced-apart dimples formed therein. Thickness at the base of each dimple is insufficient to withstand impact forces delivered thereto upon contact with a target whereas thickness between dimples is sufficient to withstand launch forces.

21 Claims, 2 Drawing Sheets

FRANGIBLE PAYLOAD-DISPENSING PROJECTILE

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to projectiles, and more particularly to a low cost frangible payload-dispensing projectile fired from a pneumatic or a buffered gun-powder launcher and suitable for use in both non-lethal riot/crowd control operations and civilian/military activities like target practice and war games.

BACKGROUND OF THE INVENTION

The use of non-lethal weapons can be an effective tool in riot/crowd control and other peace-keeping operations. Historically, however, the many types of non-lethal weapons have been of limited use during such operations. For example, hand-held or thrown blunt trauma devices (e.g., batons, etc.) lack stand-off range, thereby exposing security forces to high risk especially during large scale operations. The same stand-off range problem applies to electrical stun guns. Projectile kinetic energy devices that fire non-lethal rounds (e.g., plastic bullets, bean bag rounds, etc.) improve the stand-off range problem, but their minimum kinetic energy level (e.g., 150 Joules) delivers a projectile with a force level that can easily cause a permanent injury. Water cannons reduce the chances of inflicting a permanent injury, but their use requires the deployment of large and heavy equipment which lacks mobility and operational flexibility. Further, water cannons cannot be directed toward a particular target/individual during riot/crowd control operations.

Other examples of non-lethal weapons include a wide variety of chemical lacrimators, irritants, or inflammatory agents. However, these weapons cannot be directed toward a particular target/individual during riot/crowd control operations. Further, current deployment methods require the use of atomizers or similar mechanical and/or chemical reaction inducing devices to generate and then disperse a fine mist of the lacrimator, irritant, or inflammatory agent that is being delivered to a volumetric space. However, such volume dispersion is costly and inefficient. That is, the warhead itself is expensive and the lacrimator, irritant, or inflammatory agent (in solid or liquid form) must be diluted into a carrier (in solid or liquid form) to effect atomization. Volume dispersion also means that the weapons cannot be applied at their most potent/effective concentration possible at a particular target or targets as deemed necessary.

To summarize, current non-lethal weapons fail to provide the police and military users the stand-off range, accuracy, operational flexibility, efficiency, and selectivity in the application of non-lethal force to a particular target/individual during riot/crowd control operations.

One solution to these problems is to provide a low cost non-lethal weapon system in which a payload-dispensing frangible projectile can be fired accurately from a range of 10–50 meters to deliver, in a highly efficient manner and at a low cost, a chemical suitable for the non-lethal incapacitation of a single target/individual. Chemicals suitable for the non-lethal incapacitation of a single target/individual include chemical lacrimators, irritants, and inflammatory agents such as ortho chloro benzyl malono nitrile (CS), chloro aceto phenone (CN), oleo resin capsicum (OC), and methoxy cyclo heptra triene (MC). In addition to these chemicals capable of inflicting non-lethal incapacitation, other non-lethal chemical agents for use in riot control include paints, and/or ultraviolet dyes used alone or in combination with persistent and intolerable nauseant odorants like complex mercaptans (e.g., skunk oil, etc.), aliphatic diamines (e.g., putrescine (tetra methylene diamine)) and cadaverine (penta methylene diamine).

One common type of low cost frangible projectile used to deliver a non-lethal agent suitable for the marking of a particular target or individual is known in the art as a "paintball" which is launched towards a target by a gas-powered or pneumatic launcher. However, existing paintball designs are not suitable for the deployment of lacrimators, irritants, inflammatory agents, and/or nauseant odorants due to their excessively frangible nature and their inherent low accuracy and range limitations. Specifically, paintballs quite often break at launch because their external gelatin-based jacket is not structurally capable of reliably withstanding launch forces. This deficiency is especially pronounced when paintballs are fired from a gun powered by a fully charged gas cylinder or when the paintballs are slightly damaged due to storage conditions. Increasing paintball wall thickness does not help because the paintballs would then not fracture reliably when impacting a target.

Further, paintballs have a smooth and spherical shape. The spherical surface creates drag forces upon the paintball as it travels through the air. These aerodynamic drag forces act on the paintball to slow its velocity and limit its range and effectiveness. The drag force is due primarily to the separation of its laminar air flow behind the paintball, known as laminar pressure drag. As a result, the overall drag of a smooth sphere is quite high thereby limiting its velocity and range.

SUMMARY OF THE INVENTION

Accordingly, it is an object of the present invention to provide frangible payload-dispensing projectile.

Another object of the present invention is to provide frangible payload-dispensing projectile that can reliably withstand launch forces but fracture upon impact with a target.

Still another object of the present invention is to provide frangible payload-dispensing projectile having improved accuracy and range characteristics.

Yet another object of the present invention is to provide a frangible payload-dispensing projectile to be fired from a pneumatic or buffered gun-powder launcher and capable of reliably dispensing a non-lethal payload.

A further object of the present invention is to provide a method for the delivery of a non-lethal payload without the need to dilute the payload into a carrier to effect dispersal thereof.

Other objects and advantages of the present invention will become more obvious hereinafter in the specification and drawings.

In accordance with the present invention, a frangible payload-dispensing projectile that is to be launched from a launcher towards a target has a spherical capsule filled with a dispersible fill material. The exterior surface of the capsule has a plurality of dimples formed therein with spacing provided between each dimple. At a base of each dimple, thickness of the capsule is insufficient to withstand impact forces delivered thereto upon contact with the target. At the spacing around each dimple, thickness of the capsule is greater than at the base and is sufficient to withstand launch forces delivered thereto by the launcher.

DETAILED DESCRIPTION OF THE INVENTION

Figure 1:
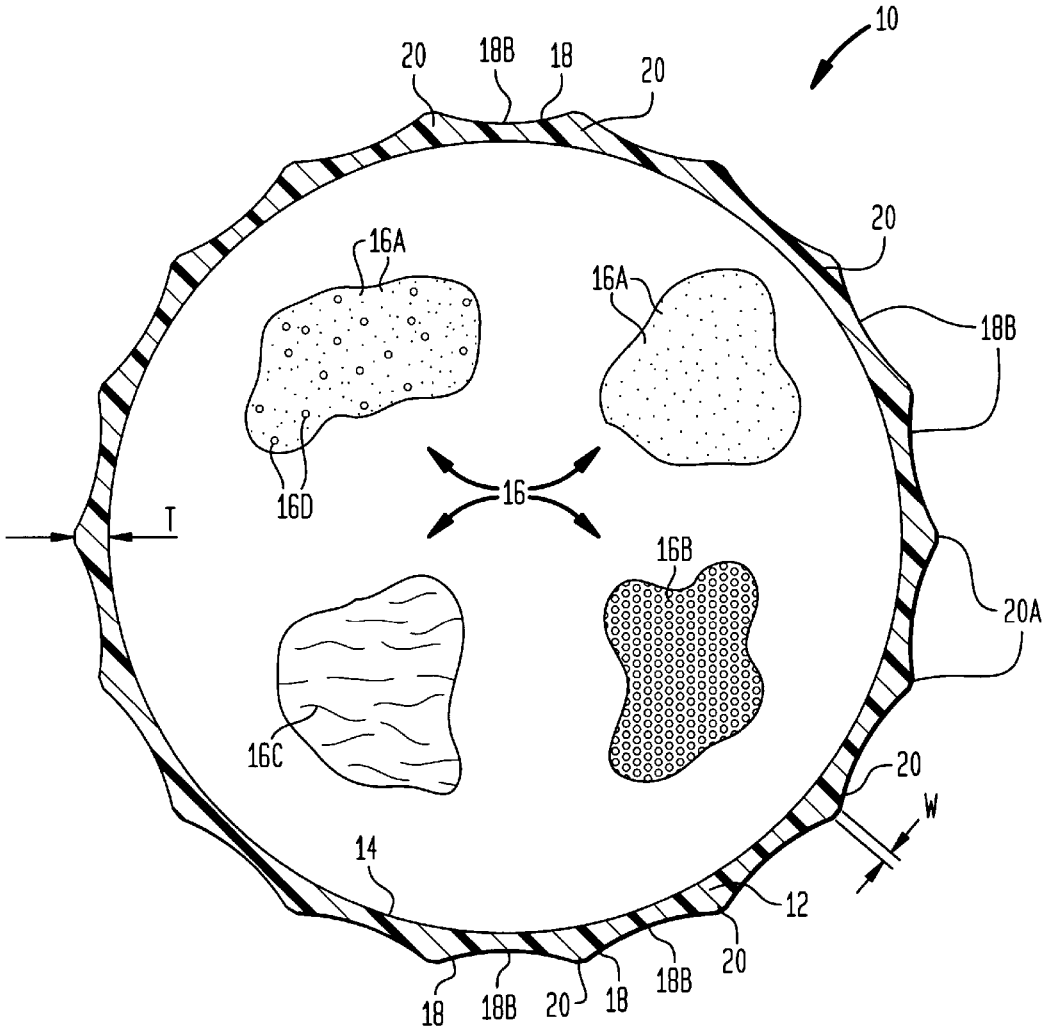
FIG. 1 is a cross-sectional view of one embodiment of a frangible payload-dispensing projectile according to the present invention.
Figure 2:
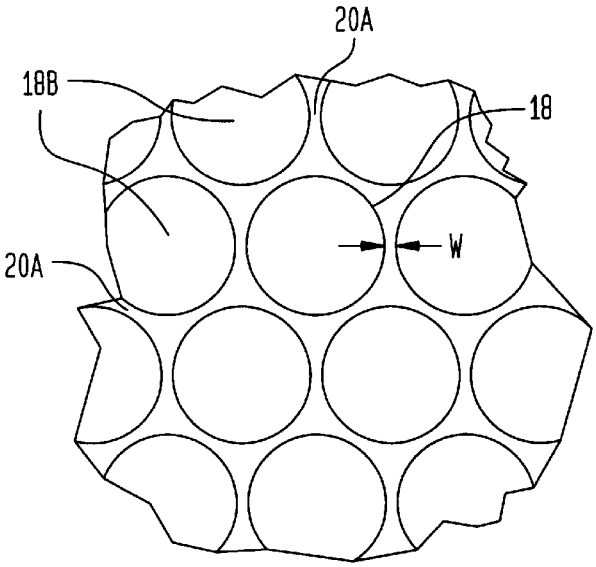
FIG. 2 is a plan view of a portion of the exterior surface of the projectile of FIG. 1 if it were laid flat.

Referring now to the drawings, and more particularly to FIGS. 1 and 2, one embodiment of a frangible payload-dispensing projectile is shown in cross-section and in plan view, respectively, and is referenced generally by numeral 10. Projectile 10 has a spherical capsule 12 that defines a closed interior chamber 14 that contains a fill material 16 to be dispensed into a surrounding environment when projectile 10 strikes a target (not shown). In general, fill material 16 is any non-lethal payload such as chemical lacrimators, irritants, inflammatory agents, paints, dyes, and/or persistent and intolerable nauseant odorants and other non-lethal payloads. It is to be understood that fill material 16 can be realized by a variety of forms without departing from the scope of the present invention. For example, capsule 12 could be filled with fill material 16 in the form of: powder or particles 16A, microcapsules 16B filled with chemicals, liquid 16C, or powder/particles 16A mixed with a high specific gravity material 16D, just to name a few. More specificity with respect to fill material 16 will be provided herein below. Spherical capsule 12 can be made from hydrophilic colloidal materials such as, but not limited to, gelatin, albumin, gum arabic, alginate, casein, agar or pectins. Capsule 12 could also be made from a synthetic organic compound such as, but not limited to, polystyrene, polypropylene, polyethylene, poloycarbonate, polyamide, polysulfane or polyvinylchloride.

In order to provide a projectile that is strong enough to survive a launch and yet frangible enough to break apart in a reliable and predictable fashion upon impact with a target, the outer surface of spherical capsule 12 is dimpled. More specifically, dimples 18 are formed in the outer surface of capsule 12 and distributed uniformly thereabout with spaces 20 forming ridges therebetween. As shown, each dimple 18 is a spherical depression formed in the outer surface of capsule 12 such that the thickness of capsule 12 is thinnest at each base 18B of dimples 18. The thickest portion of capsule 12 is at spaces 20 between dimples 18.

Spaces 20 are contiguous about capsule 12 and fully surround each dimple 18 as best seen in FIG. 2. The width W of each space 20 at its narrowest portion can be altered by varying the number of dimples, the size of the dimples, or a combination of the number and size of the dimples. The surface 20A of each space 20 can be flat (if dimples 18 are large such that width W is very small) or rounded to conform to an overall curvature of capsule 12.

In general, the thickness T of capsule 12 at spaces 20 must be sufficient to withstand launch forces when fired from a gun or launcher. However, the thickness at each base 18B is such that a localized stress point is defined to serve as a point of local fracture when projectile 10 impacts a target. Projectile 10 is stiff because of the wall thickness at spaces 20 around each dimple 18. However, at target impact, projectile 10 deforms beyond the limits previously imposed at launch so that each dimple 18 acts as a localized stress point. More specifically, stress forces are applied to projectile 10 at the target impact surface area and at the rapidly increasing diameter of projectile 10 as a result of impact deceleration forces. Projectile 10 continues to compress on impact until stresses exceed the strength limit of bases 18B resulting in crack failure initiation with full crack propagation thereafter following classical failure propagation theory. The uniform distribution of dimples 18 and spaces 20 provides both structural integrity and predictable fracture characteristics.

The range and accuracy characteristics of projectile 10 are also enhanced by dimples 18. During flight, the dimple structure provides increased surface drag which results in significantly lower overall drag due to associated reductions in laminar pressure drag. Since pressure drag reductions are more significant than surface drag increases, a net increase in aerodynamic efficiency results. Thus, unlike a smooth and spherical paintball, projectile 10 produces turbulent flow which actually results in lower pressure drag and hence greater velocity over time and subsequently greater range. Additionally, the uniform distribution of dimples 18 provides a uniform surface of large imperfections that increases accuracy because the large imperfections are spread out uniformly over the surface to evenly distribute aerodynamic loading and hence reduce the occurrence of trajectory altering side forces. As a result, dimpled projectile 10 produces uniform turbulent flow which results in greater range and increased accuracy.

Figure 3:
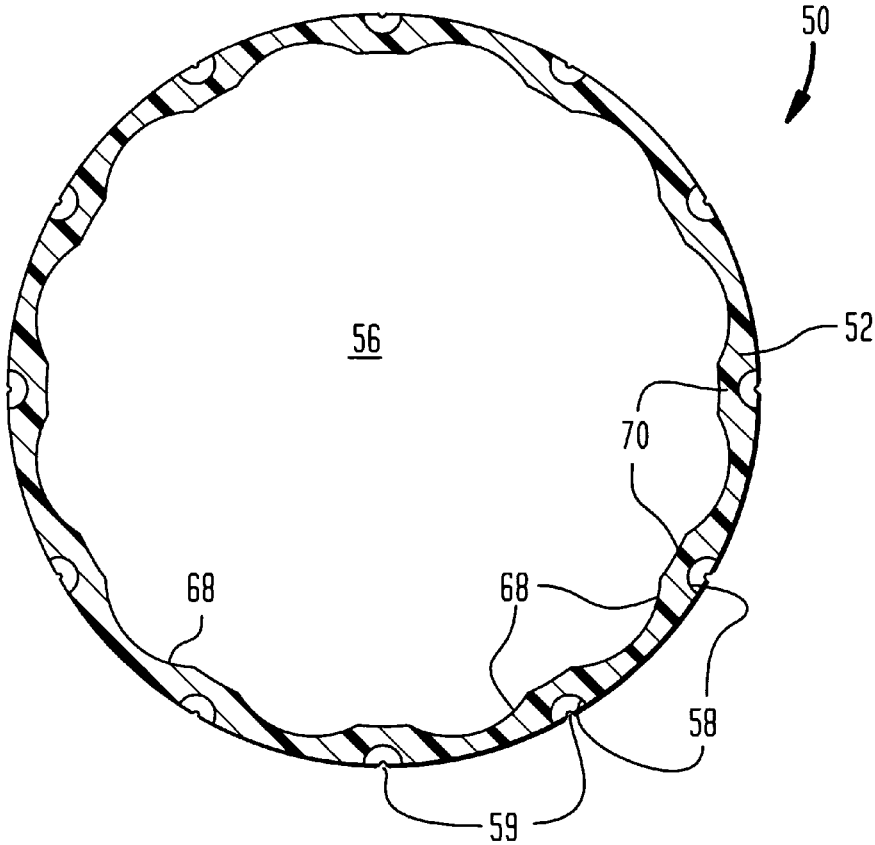
FIG. 3 is a cross-sectional view of another embodiment of a frangible payload-dispensing projectile according to the present invention.
Figure 4:
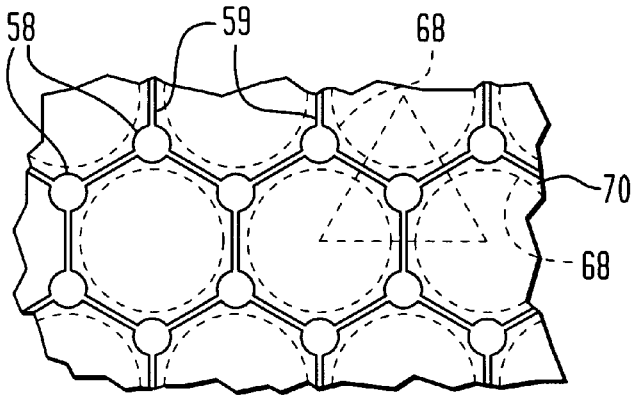
FIG. 4 is a plan view of a portion of the exterior surface of the projectile of FIG. 3 if it were laid flat.

Another embodiment of the present invention is illustrated in FIGS. 3 and 4 where projectile 50 has its outer and inner surfaces dimpled. A spherical capsule 52 defines a closed interior chamber 54 that contains a fill material 56 to be dispensed into a surrounding environment when projectile 50 strikes a target. Fill material 56 is any non-lethal payload similar to fill material 16 described above. The interior of capsule 52 has dimples 68 formed therein with spaces 70 forming ridges therebetween.

The particular inner and outer dimple/space pattern can be selected and/or optimized for a particular application. By way of example, FIGS. 3 and 4 depict a triangular pattern 66 of spherical dimples 68 (i.e., the centers of any three dimples 68 are arranged in a triangle) on the interior surface and a hexagonal pattern 69 of spherical dimples 58 aligned at spaces 70 between dimples 68. That is, each hexagonal pattern of dimples 58 is concentric with one of dimples 68. Exterior dimples 58 could also be connected by drag enhancing airflow channels 59 cut into the exterior surface of capsule 52 along spaces 70. Note that airflow channels 59 could be employed with or without the presence of interior dimples 68.

The design approach presented in FIGS. 3 and 4 can be adjusted for a particular application. For example, smaller interior dimples could be used to allow for larger exterior dimples and airflow channels connecting the exterior dimples. Likewise, a larger number of smaller diameter interior dimples could be used resulting in a smaller pattern of associated exterior dimples and, if used, airflow channels.

A projectile of the present invention can be made in a variety of ways. For example, it can be made using gelatin encapsulation equipment in which hot liquid gelatin is formed into two thin ribbons. The gelatin ribbons pass over a set of rotating dies designed to form two hemispherical capsules slightly larger than the desired projectile diameter. The size of the projectile is dependent on the size of the gun used to launch same. Each die and its flow of gelatin ribbon presses against the other die as the die rotates. As the dies meet, fill material is injected into the area between the two gelatin ribbons. The dies rotate, press the warm gelatin sheets against one another and form a filled gelatin capsule. The dies rotate further and the capsule drops out into a holding bin, where the capsules are gently transferred to a gentle tumbler to help the gelatin maintain roundness during cooling and drying. To make dimples 18, the hemispherical dies would incorporate protrusions to form the dimples upon the pressing of the gelatin ribbons.

Another method by which a projectile of the present invention can be made involves taking already formed and filled smooth capsules and setting them into a two-piece mold of hemispheres having uniformly distributed protrusions. The two halves of the mold are clamped around the smooth capsules with uniform pressure and heated to a temperature appropriate for the gelatin to yield and flow to the form of the mold. The dimpled mold would then be cooled. The mold would be opened and the dimpled projectile released. The mold could be non-stick coated or sprayed with lubricant prior to the molding process to facilitate release.

Still another method by which a projectile of the present invention can be made involves the use of pre-made sheets of gelatin of an appropriate thickness. The warmed sheets of gelatin could be stamped using a heavy cylinder having uniformly distributed protrusions that are rolled and pressed into the gelatin sheets. The stamped sheet would then be allowed to cool. Next, two sheets would be moved past two hemispherical dies that would close together upon the two sheets. Just prior to the two gelatin sheets touching, pressurized fill material would be injected between the sheets to press the gelatin against the sides of the molds. The two molds would be closed together and an outer heated ring would seal the gelatin capsule closed. The mold would be opened to allow the dimpled projectile to fall out.

Commercial paintball manufacturing processes generally create mold marks that can affect ballistic performance. The present invention can overcome this limitation by using additional false mold markings to create an evenly dispersed set of mold marks. The false mold marks can be as small as the conventional mold marks or much larger, e.g., resembling the airflow channels described above. Thus, the false mold marks could be used alone or in conjunction with dimples.

The advantages of the present invention are numerous. The dimpled projectile is strong because the non-dimpled area provides needed thickness to withstand launch stresses, but breaks easily on impact due to the dimples which create shear stress concentration points that cause jacket failure upon impingement with an object. The dimpled projectile is also more aerodynamic and will fly farther than existing smooth-surface frangible projectiles (i.e., paintballs). Accuracy is also improved since the dimpled projectile will not be adversely affected by wind or body deformation at launch. Thus, the present invention provides a projectile that is easy to make, handle and use, and at the same time provide the ability to accurately direct a non-lethal weapon to a particular target from a safe stand-off distance. This reduces the risk to both the crowd control personnel and the crowd at large.

The present invention could be used to deliver consecutive frangible payload-dispensing projectiles of different payloads which, when impacted upon an individual insurgent target, interact physically and chemically to effect an intended binary chemical reaction. For example, a first projectile could contain a lacrimator (e.g., CN) with the next projectile delivering an energizer (e.g., such as 3,3-bis azido methyl oxetane) that increases the potency of the lacrimator. The advantages of a binary reaction could also be achieved with a single projectile known as a unitary binary projectile. Reactive chemicals within the projectile are kept separate from one another by means of micro-encapsulation. The small capsules break during the deployment environment or at target impact so that the binary payloads mix physically and chemically to effect the intended binary chemical reaction on the target. That way, potential compatibility problems related to the manufacture and/or storage of the loaded frangible projectile can be addressed and minimized.

The present invention could further be used to deliver a non-lethal payload in a substantially pure form as a dry powder, a liquid or with the chemical agent in a diluted form using an inert or active ingredient carrier in either a dry powder or liquid state. For example, CS or CN can be delivered in a substantially pure form or dissolved with dimethyl formamide or dimethyl acetamide or 3,3-bis azido methyl oxetane (active ingredient for CN only), forming a fluid-containing projectile that provides controlled CS or CN concentration and ensures that the CS or CN riot/crowd control agent is delivered to and stays on the intended target through absorption/adsorption, with very little collateral CS or CN exposure to nearby bystanders. Likewise, MC can be mixed/dissolved with a compatible anti-oxidant and a volatile solvent. Riot/crowd control agents such as CS, CN and OC can also be dissolved in chemically compatible anionic and/or non-anionic surfactants using aqueous or non-aqueous volatile solvents to include, for example, ethoxylated nonyl phenols, ethoxylated alcohols, sodium lauryl sulfate, ethoxylated alkyloamide, water, and/or poly ethylene glycol.

Finally, since most of the above-described non-lethal payloads do not have a high specific gravity (as compared to a standard bullet), particles of a high specific gravity material (e.g., lead, tungsten, steel, etc.) can be dispersed or homogeneously mixed as a suspension with the riot/crowd control chemical. This will increase the overall specific gravity of the frangible projectile and thereby increase its range potential and reduce wind effects thereon.

Although the invention has been described relative to a specific embodiment thereof, there are numerous variations and modifications that will be readily apparent to those skilled in the art in light of the above teachings. For example, each dimple could be a shape other than a spherical depression such as a polygonal "star" shape where the polygonal shape at the outer surface of capsule 12 slopes down to a center base defining the thinnest portion of the capsule. It is therefore to be understood that, within the scope of the appended claims, the invention may be practiced other than as specifically described.

What is claimed as new and desired to be secured by Letters Patent of the United States is:

1. A frangible payload-dispensing projectile that is to be launched from a launcher towards a target, comprising:

a spherical capsule defining a closed interior and defining an exterior surface having a plurality of dimples formed therein with areas of spacing provided between said plurality of dimples wherein, at a base of each of said plurality of dimples, thickness of said spherical capsule is insufficient to withstand impact forces delivered thereto upon contact with said target and wherein, at said spacing, thickness of said spherical capsule is greater than said thickness at each said base and sufficient to withstand launch forces delivered thereto by said launcher, said capsule further having drag-enhancing channels cut into said capsule at said exterior surface in said areas of spacing, wherein each of said channels terminates at either end thereof at one of said plurality of dimples;

a second plurality of dimples formed in an interior surface of said spherical capsule, each of said second plurality of dimples aligned with one of said areas of spacing between said plurality of dimples formed on said exterior surface; and a dispersible fill material contained within said closed interior.

2. A projectile as in claim 1 wherein each of said plurality of dimples is part spherical.

3. A projectile as in claim 1 wherein each of said plurality of dimples is identical.

4. A projectile as in claim 1 wherein said spherical capsule is constructed from a synthetic organic compound.

5. A projectile as in claim 1 wherein said spherical capsule is constructed from a hydrophilic colloidal material.

6. A projectile as in claim 1 wherein said dispersible fill material is non-lethal.

7. A projectile as in claim 1 wherein said dispersible fill material is micro-encapsulated.

8. A projectile as in claim 1 wherein said dispersible fill material includes a high specific gravity material selected from the group consisting of lead, tungsten and steel.

9. A projectile as in claim 1 wherein said plurality of dimples are uniformly distributed about said exterior surface.

10. A projectile as in claim 1 wherein each of said second plurality of dimples is part spherical.

11. A projectile as in claim 1 wherein said second plurality of dimples are uniformly distributed about said interior surface.

12. A frangible payload-dispensing projectile that is to be launched from a launcher towards a target, comprising:

a spherical capsule defining a closed interior and defining an exterior surface having a plurality of identical dimples formed therein and uniformly distributed thereabout with areas of spacing provided between said plurality of identical dimples wherein, upon impact with said target, localized fractures form in said spherical capsule at each base of said plurality of identical dimples, said capsule further having drag-enhancing channels cut into said capsule at said exterior surface in said areas of spacing, wherein each of said channels terminates at either end thereof at one of said plurality of identical dimples;

a second plurality of identical dimples formed in an interior surface of said spherical capsule, each of said second plurality of identical dimples aligned with one of said areas of spacing between said plurality of identical dimples formed on said exterior surface; and a dispersible fill material contained within said closed interior.

13. A projectile as in claim 12 wherein each of said plurality of identical dimples is part spherical.

14. A projectile as in claim 12 wherein said spherical capsule is constructed from a synthetic organic compound.

15. A projectile as in claim 12 wherein said spherical capsule is constructed from a hydrophilic colloidal material.

16. A projectile as in claim 12 wherein said dispersible fill material is non-lethal.

17. A projectile as in claim 12 wherein said dispersible fill material is micro-encapsulated.

18. A projectile as in claim 12 wherein said dispersible fill material includes a high specific gravity material selected from the group consisting of lead, tungsten and steel.

19. A projectile as in claim 12 wherein said second plurality of identical dimples are arranged in a repeating triangular pattern and said plurality of identical dimples formed on said exterior surface are arranged in a repeating hexagonal pattern, wherein each said hexagonal pattern is concentric with one of said second plurality of identical dimples.

20. A projectile as in claim 12 wherein each of said second plurality of identical dimples is part spherical.

21. A projectile as in claim 12 wherein said second plurality of identical dimples are uniformly distributed about said interior surface.

* * * * *